United States Patent [19]

Wenig et al.

[11] Patent Number: 4,649,965

[45] Date of Patent: Mar. 17, 1987

[54] PICKING ARRANGEMENT FOR A WEAVING MACHINE

[75] Inventors: Ernst Wenig, Oehningen, Fed. Rep. of Germany; Lorant Gacsay, Zurich; Paul Lincke, Zell, both of Switzerland

[73] Assignee: Sulzer Brothers Limited, Winterthur, Switzerland

[21] Appl. No.: 817,423

[22] Filed: Jan. 9, 1986

[30] Foreign Application Priority Data

Jan. 28, 1985 [EP] European Pat. Off. ..... 85100856.5

[51] Int. Cl.[4] ..... D03D 47/34

[52] U.S. Cl. ..... 139/439; 139/450

[58] Field of Search ..... 139/429, 437, 438, 439, 139/450, 194

[56] References Cited

U.S. PATENT DOCUMENTS 2,589,429 3/1952 Pfarrwaller ..... 139/439

4,513,792 4/1985 Lincke ..... 139/439

*Primary Examiner*—Henry S. Jaudon

*Attorney, Agent, or Firm*—Kenyon & Kenyon

[57] ABSTRACT

The arrangement is operative to pick at least one weft yarn for weaving machines and comprises a pair of weft yarn tensioning devices the second of which provides a loop of yarn whose length is equal to the length of weft yarn transferred by the main nozzle to the projectile and which is released for transfer to the projectile before the first tensioning device releases the weft yarn for picking. The second tensioning device draws back an equally long portion of the weft yarn after picking. The arrangement prevents a weft yarn end from not being transferred from the nozzle to the projectile so that the weft yarn is not picked.

15 Claims, 9 Drawing Figures

PICKING ARRANGEMENT FOR A WEAVING MACHINE

This invention relates to a picking arrangement for a weaving machine.

As is known, weaving machines have been provided with various types of picking arrangements for the picking of one or more weft yarns into a shed. For example, in the case of a gripper projectile weaving machine, a picking arrangement has been known which is constructed with a weft yarn tensioning device and a weft yarn transfer device for retaining a weft yarn until the yarn can be transferred to a picking device, for example a projectile. As described in European O.S. No. 090878, the weft yarn tensioning device has been provided with a yarn tensioner which can be raised at a relatively reduced speed from an initial position into an intermediate position so that the tensioner remains in contact with the weft yarn to be picked when the yarn is being pulled by an air nozzle for subsequent transfer to a projectile. This transfer at a reduced speed is to allow a reliable transfer of a weft yarn. Thereafter, the yarn tensioner rises rapidly from the intermediate position into an end position free of the yarn.

It has been found by experience that the yarn tensioner should remain stationary in the short pause between the two movement cycles until the projectile has engaged the weft yarn end and the projectile is ready for picking. However, the yarn tensioner must move toward the end position before the instant at which picking begins so that the weft yarn is not torn by the frictional resistance at the reversal positions of the tensioner. Thus, the weft yarn can build up before the projectile such that the weft yarn end may take up a skewed position relative to the projectile before complete closure of the projectile. Thus, during a subsequent abrupt picking movement, the weft yarn end may not be taken up by the projectile and may become a lost weft yarn. Alternatively, the yarn end may come between a striker of the picking device of the projectile and be squeezed during picking.

Accordingly, it is an object of the invention to provide a picking arrangement in which a weft yarn can be picked in a reliable manner.

It is another object of the invention to provide a picking arrangement for a multiplicity of weft yarns in a weaving machine.

It is another object of the invention to provide a relatively simple picking arrangement for a weaving machine which ensures reliable transfer of a weft yarn.

Briefly, the invention provides a picking arrangement for at least one weft yarn in a weaving machine which is comprised of a first tensioning device for forming a first loop in a weft yarn, a transfer device for retaining the weft yarn for insertion of an end of the weft yarn into a picking device and a second tensioning device for forming a second loop in the weft yarn upstream of the transfer device. The second tensioning device is also movable into a release position in order to release the second loop of weft yarn to the transfer device for insertion of the weft yarn end into a picking device.

In one embodiment, the first tensioning device includes a pair of yarn guides for guiding the weft yarn, a yarn tensioner having a bar disposed transversely of the weft yarn for reciprocating movement between the guides and between an initial position to hold a loop of weft yarn and a release position to permit release the loop of weft yarn, and retaining means for releasably holding the weft yarn in the initial position of the tensioning device. In this embodiment, the second tensioning device includes at least a pair of yarn guides for guiding the weft yarn and a yarn tensioner for reciprocating between the yarn guides and between an initial position to hold the second loop of weft yarn and a released position to release the second loop of weft yarn to the transfer device. In this embodiment, a means is provided to move the tensioner of the second tensioning device into the release position so that a weft yarn end can be inserted into a picking device while thereafter actuating the first tensioning device to move the tensioner thereof into the released position for picking of the weft yarn via the picking device.

In another embodiment, the second tensioning device may employ a pivotal lever which is connected to one of the guides of the first tensioning device in order to move that guide in a manner so that a length of yarn can be fed into the transfer device for insertion into a picking device.

In still another embodiment, the tensioner of the second tensioning device may include at least two deflectors for movement relative to three yarn guides in order to form two loops of yarn which can be subsequently released to the transfer device for insertion of the yarn into a picking device.

In still another embodiment, wherein pairs of tensioning devices are used to form loops in each of two respective weft yarns, a common tensioning device may be used to form the second loops in an alternating manner in each weft yarn for insertion into respective picking devices.

These and other objects and advantages of the invention will become more apparent from the following detailed description taken in conjunction with the accompanying drawings wherein.

Figure 1:
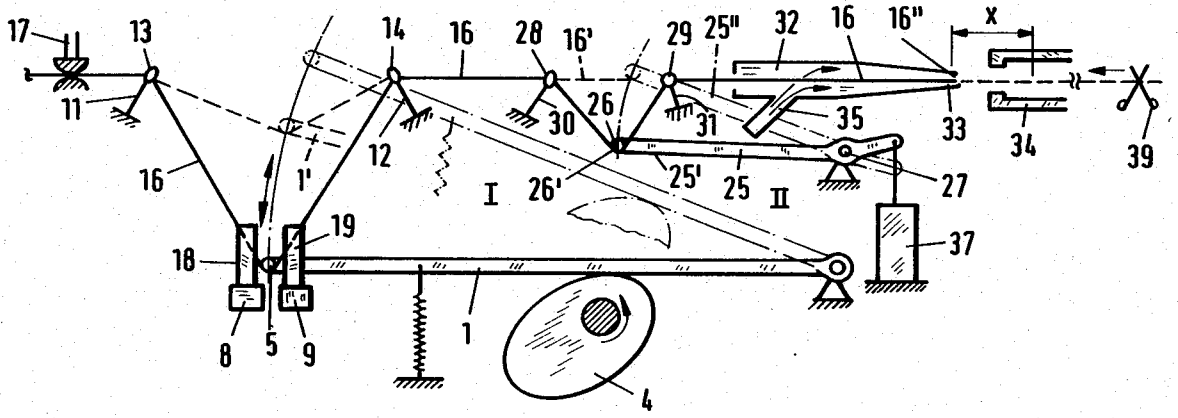
FIG. 1 illustrates a diagrammatic side view of a picking arrangement constructed in accordance with the invention.
Figure 2:
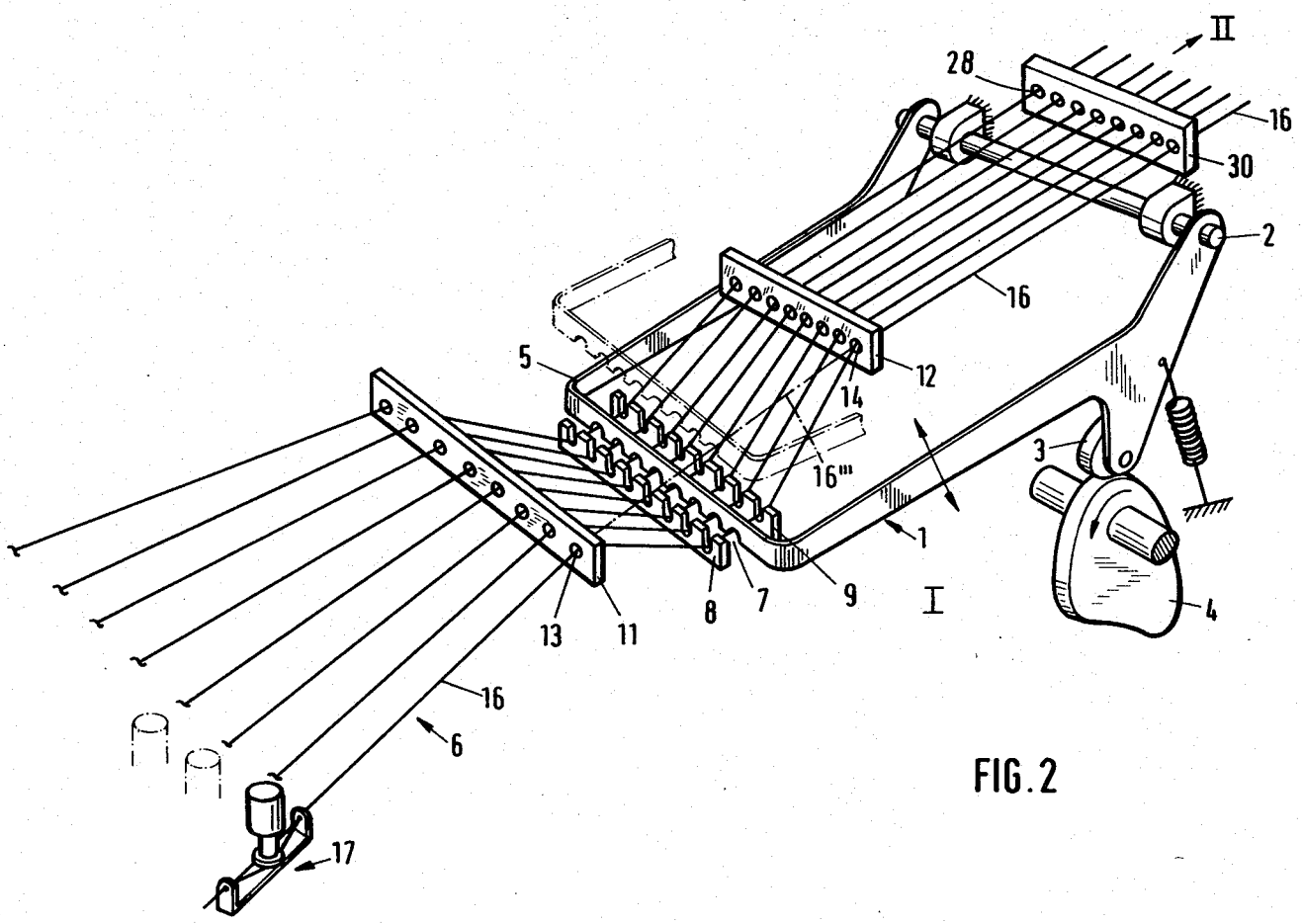
FIG. 2 illustrates a perspective view of a first tensioning device of the picking arrangement of FIG. 1.

Referring to FIGS. 1 and 2, the picking arrangement is constructed for the pattern-programmed weft-mixing picking of eight weft yarns into a weaving machine (not shown). As indicated the picking arrangement includes a pair of weft yarn tensioning devices I, II, a weft yarn transfer device in the form of a main pneumatic nozzle 32 and a picking device represented by a yarn clamp 34 of the projectile.

Figure 3:
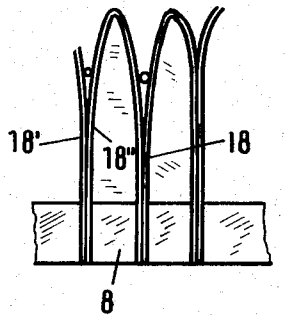
FIG. 3 illustrates an enlarged view of a retaining element used in the embodiment of FIG. 1.

The first tensioning device I includes a yarn tensioner 1 which is in the form of a stirrup rotatable around a pivot 2. The tensioner 1 is guided by way of a roller 3 on a cam 4 driven by the main shaft of the weaving machine so as to oscillate a cross-beam or bar 5 thereon at the machine cadence transversely of the weft yarns 6, each of which is drawn off a supply package (not shown). As indicated, the cross-beam 5 includes eight troughs 7 for receiving the yarns 6 while a pair of carriers 8, 9 are disposed on opposite sides of the troughs 7 in known fashion. Each carrier 8, 9 is provided with a plurality of retaining means (not shown in FIG. 2) for releasably holding a respective weft yarn 6. For example, as indicated in FIG. 3, each retaining means on the carrier 8 is formed of a pair of retaining elements 18', 18'' which are resiliently disposed so as to releasably retain a deflected weft yarn. As indicated in FIG. 1, the carrier 9 mounts similar retaining means 19.

The tensioning device I also includes a pair of carriers 11, 12 on opposite sides of the beam 5, each of which includes eight yarn guides 13, 14, respectively, for the weft yarns 6.

The construction of the yarn tensioner I is of generally known construction and need not be further described.

As indicated in FIGS. 1 and 2, a yarn brake 17 is provided for each weft yarn 16 upstream of the tensioning device I.

Referring to FIG. 1, the yarn tensioner II is formed of eight yarn tensioners 25 each of which is in the form of a lever having a yarn trough 26 and which is rotatable around a pivot 27. In addition, the tensioner includes a pair of yarn guides 28, 29 which are disposed on opposite sides of a trough 26 of each lever 25. Further, each guide 28, 29 is formed in the manner of an eyelet in a respective carrier 30, 31, as indicated in FIG. 2.

The pneumatic nozzle 32 is constructed with individual guide channels to receive each of the eight yarns 6 and has a single exit orifice 33 which terminates before a gripper projectile in the ready-to-pick position. In addition, the nozzle 32 has a line 35 through which compressed air can be supplied into each guide channel.

Referring to FIG. 1, a means in the form of a motor 37 is provided to actuate each tensioner 25 in accordance with a pattern program and in synchronism with the tensioner I so that the selected tensioner 25 moves up and down between a deflected initial position 25' and a raised release position 25'. The cam 4 serves as a means for actuating the tensioner 1 of the tensioning device I.

In operation, with the picking arrangement in the initial position indicated in solid line in FIG. 1, the yarn tensioners 1, 25 deflect all of the weft yarns 6. The weft yarns 6 which are deflected by the cross-member 5 are retained in this position by the retaining elements 18, 19 on the carriers 8, 9. At this time, all of the weft yarns in the two tensioning devices I, II are tensioned by being pulled by the compressed air flowing through the nozzle 32. At the same time, the yarn clamp 34 is opened.

Figure 4:
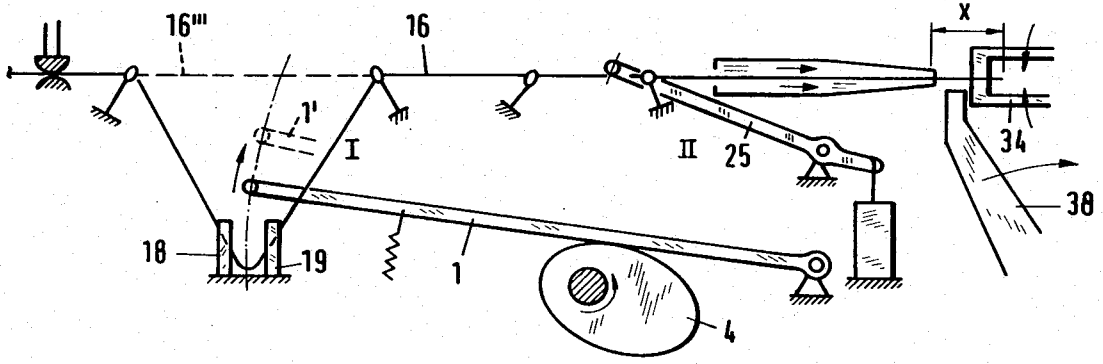
FIG. 4 illustrates a view similar to FIG. 1 of the picking arrangement after insertion of a weft yarn end into a picking device in accordance with the invention.

During picking of the selected weft yarn, for example the first weft yarn 16, the associated tensioner 25 first pivots clockwise so that the weft yarn 16 is free to be stretched by the draught through the nozzle 32 into the position 16'. The nozzle 32 then blows the weft yarn end 16'' into the clamp 34 with the weft yarn advancing by a length x referred to here as the transfer length. The yarn clamp 34 then closes. The picking arrangement is then in the position illustrated in FIG. 4.

At the start of the release movement of the tensioner 25, the cam 4 raises the tensioner 1 of the tensioning device I. However, the retaining elements 18, 19 retain the yarn 16 in the deflected position. Upon completion of the transfer of the weft yarn to the yarn clamp 34, the tensioner 1 has reached the dotted line position 1'. The projectile is then picked by a picking mechanism 38 (FIG. 4) into the shed with the weft yarn 16 being drawn out of the retaining elements 18, 19.

The yarn brake 17 for the weft yarn 16 opens before picking so that the weft yarn 16 can be drawn off the supply package (not shown) to the length required for picking and picked into the shed.

During the initial phase of picking, the cam 4 raises the tensioner 1 continuously so that the weft yarn 16 is free to be stretched by the pull of the projectile clamp 34 into the position 16'''. The weft yarns which are not to be picked remain clamped in the respective retaining elements. Similarly, the corresponding tensioners of the tensioning device II for these weft yarns remain in the deflected positions.

After the projectile has pulled the weft yarn through the shed, the projectile is braked in a catcher (not shown) and pushed back by an ejector (not shown) until reaching an ejection position. The cam 4 simultaneously lowers the tensioner 1 so that weft yarn stays stretched. Edge yarn clamps (not shown) on both sides of the shed then take over the weft yarn. The yarn is then severed on the picking side by a cutter 39 (FIG. 1) and released from the projectile on the catching side by opening of the clamp 34. The yarn is then beaten-up by a reed in known manner. The weft yarn is then deflected further by the still descending yarn tensioner 1 as well as by the descending yarn tensioner 25 until the weft yarn end is disposed in the nozzle exit orifice 33. While the yarn tensioner 1 moves to the initial position with the weft yarn, the weft yarn is clamped fast between the retaining elements 18, 19.

A conveyor (not shown) receives the projectile ejected from the catcher (not shown) and conveys the projectile outside the shed to the picking station. The projectile is then opened by an opener and pivoted by a projectile lift (not shown) before the nozzle in readiness to receive the next weft yarn. This position is as shown in FIG. 1.

Figure 5:
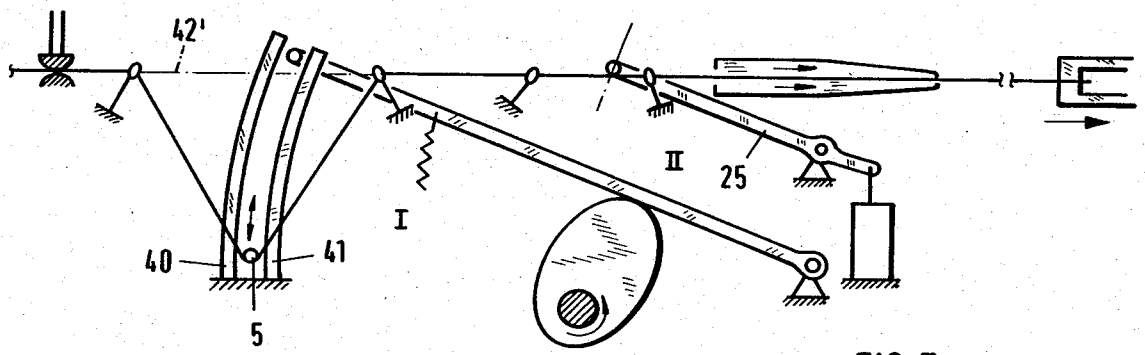
FIG. 5 illustrates a modified picking arrangement in accordance with the invention.

Referring to FIG. 5, the picking arrangement may be modified to the extent that the weft yarn retaining elements 40, 41 of the tensioning device I extend as far as, or possibly beyond, the height of the stretched weft yarns 42'. That is, the retaining elements 40, 41 extend between the initial solid line position of the tensioning device I and the release position indicated in dotted line by the stretched yarn 42'. Retaining elements of this length retard the weft yarn substantially throughout the stretching movement. In addition, the friction experienced by the weft yarn ensures that the yarn is stretched uniformly and smoothly during picking and is thus not overloaded.

Figure 6:
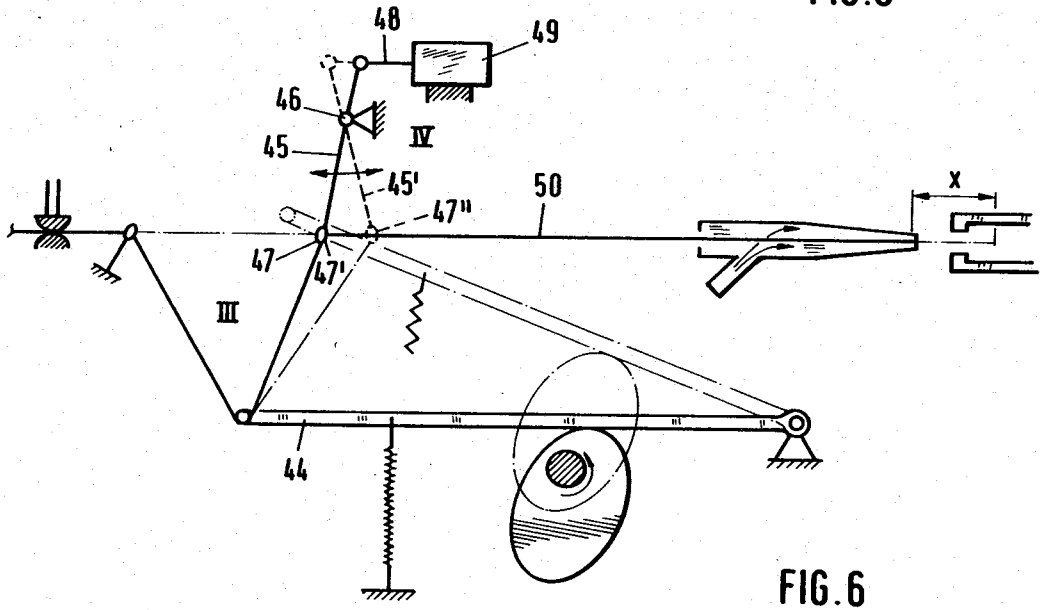
FIG. 6 illustrates a further modified picking arrangement in accordance with the invention.

Referring to FIG. 6, the picking arrangement may be provided with a tensioning device III having a yarn tensioner 44 for each yarn and a second tensioning device IV having a yarn tensioner 45 for each yarn wherein a yarn guide 47 is common to each device III, IV. As indicated, the yarn tensioning device III has a pair of yarn guides between which the tensioner 44 pivots with the downstream guide 47 being movable. The tensioning device IV includes a yarn tensioner 45 for each weft yarn which is in the form of a double lever and which is rotatable around a fixed position 46. In addition, the free end of the tensioner 45 is secured to the movable yarn guide 47 while the opposite end is connected to an actuating rod 48 of a servomotor 49.

In operation, the weft yarn 50 to be picked is transferred to the projectile yarn clamp by a counter-clockwise rotation of the yarn tensioner 45. In this regard, the yarn tensioner moves the yarn guide 47 from the initial position 47' to the right into a release position 47''. The weft yarn 50 therefor experiences some stretching or forwards movement which is sufficient for the yarn length x to be released for transfer to the projectile. After picking and during the return of the projectile, i.e. after severance of the weft yarn on the picking side, the tensioning devices III, IV pivot back to their deflecting positions.

Figure 7:
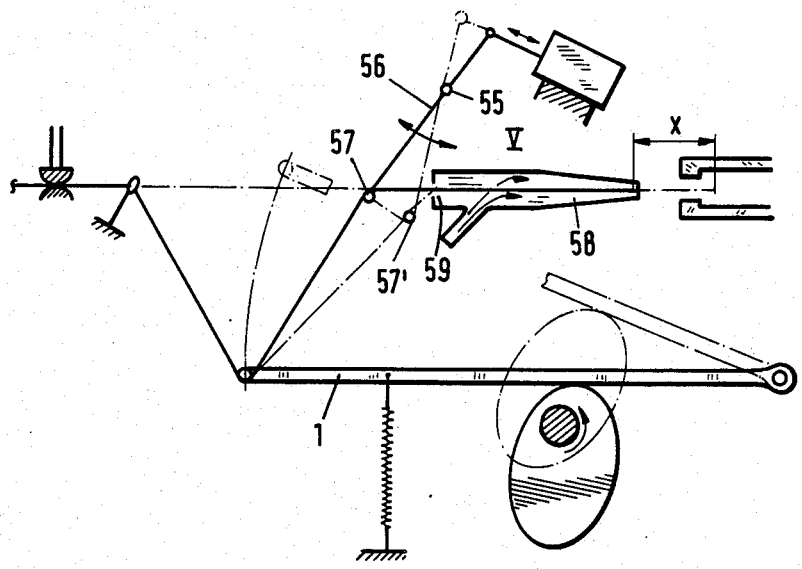
FIG. 7 illustrates a still further modified picking arrangement in accordance with the invention.

Referring to FIG. 7, the picking arrangement which is similar to that as illustrated in FIG. 6, employs a tensioning device V having a yarn tensioner 56 pivotally mounted on a fulcrum 55 which is chosen so that, at the end of the release movement of the tensioning device V, a yarn guide 57 on the tensioner 56 is moved into a position 57' below a main nozzle 58. The advantage of this feature is that the undersides of the entries 59 of the weft channels in the nozzle 58 serve as yarn guides.

Figure 8:
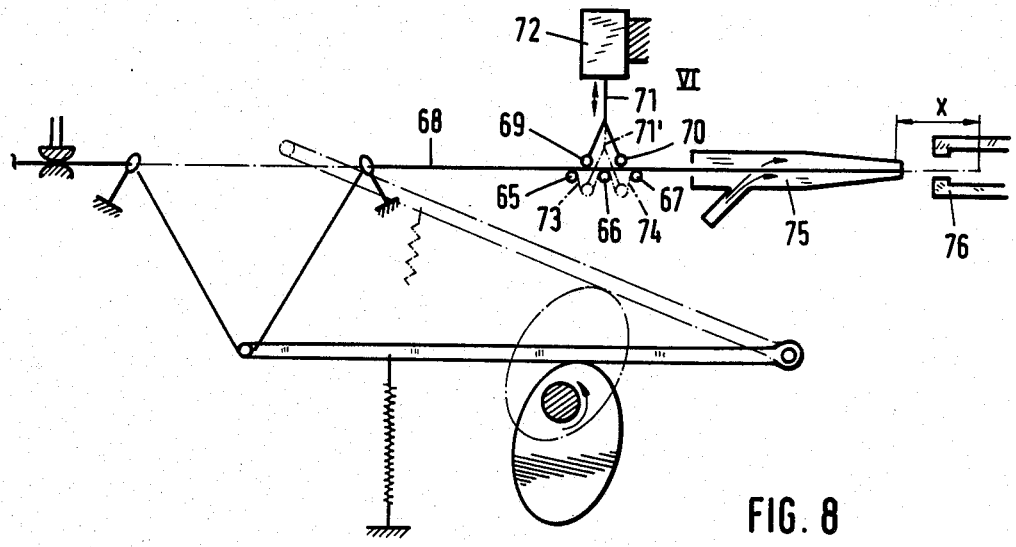
FIG. 8 illustrates a diagrammatic view of a modified picking arrangement having a tensioning device for forming a pair of loops for insertion of a weft in a picking device in accordance with the invention.

Referring to FIG. 8, the picking arrangement may be constructed with a tensioning device VI which has a pair of deflectors 69, 70 to one side of the selected weft yarn 68 which cooperate with three yarn guides 65, 66, 67 below the weft yarn 68. As indicated, the deflectors 69, 70 are secured to an actuating rod 71 of a servomotor 72. In the initial position, th deflectors 69, 70 are disposed between the yarn guides 65, 66 and 66, 67, respectively so that two yarn loops 73, 74 are formed. At the same time, the end of the weft yarn 68 is disposed in the exit orifice of a main nozzle 75 for subsequent insertion into a yarn clamp 76.

In order to transfer the weft yarn to the yarn clamp 76, the motor 72 raises the rod 71 from the bottom position 71' indicated in dotted line so that the two loops 73, 74 in the selected yarn 68 are released and are stretched to provide the transfer length x required for transfer to the projectile clamp 76. During the return of the projectile and after picking-side severance of the weft yarn, the two tensioning devices move back into the deflecting positions.

Figure 9:
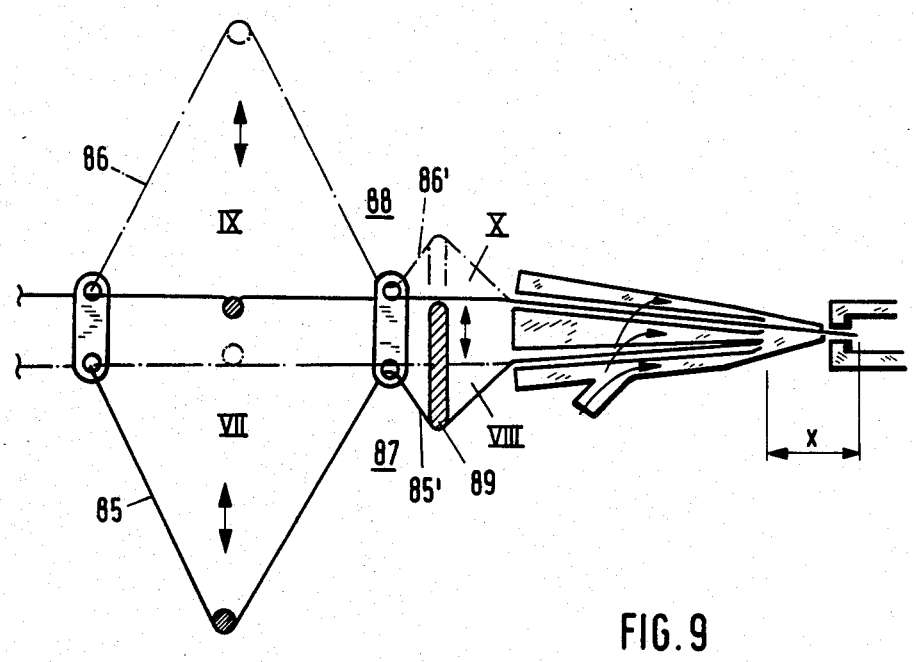
FIG. 9 illustrates a diagrammatic side view of a picking arrangement for pairs of weft yarns.

Referring to FIG. 9, the picking arrangement can be constructed for the picking of weft yarns in a two-weft or weft-mixing operation. In this regard, two weft yarns can be picked alternately or alternately in accordance with a particular pattern program. In this case, as illustrated, a picking device 87 is provided for one weft yarn 85 while a second picking device 88 is provided for the second weft yarn 86. Further, the picking device 87 comprises a pair of tensioning devices VII, VIII while the picking device 88 comprises a pair of tensioning devices IX, X. The two picking devices 87, 88 operate alternately or in accordance with a pattern program, as herein before described. In addition, a common yarn tensioner 89 is provided between the tensioning devices VIII, X so as to form loops 85', 86' in the respective weft yarns 85, 86 in an alternating manner. In this regard, the common tensioner 89 is disposed to oscillate transversely of the weft yarns 85, 86 at the cadence of the weaving machine.

The picking arrangement may be used for gripper projectile weaving machines as described above as well as in weaving machines having other forms of picking devices. Further, the picking arrangement can be turned 180° from the illustrated position so that yarns may be deflected upwardly instead of downwardly.

The invention thus provides a picking arrangement which is of relatively simple construction and one which ensures that the end of a weft yarn can be reliably positioned in a yarn clamp for picking.

What is claimed is:

1. A picking arangement for at least one weft yarn in a weaving machine comprising a first weft yarn tensioning device for forming a first loop in a weft yarn in an initial position;

retaining means for releasably holding the weft yarn in said inital position of said first tensioning device;

a weft yarn transfer device for retaining the weft yarn;

a picking device for receiving an end of the weft yarn from said transfer device for picking; and a second weft yarn tensioning device upstream of said transfer device and movable beteeen an initial position to hold at least a second loop of weft yarn thereat and a release position to release said second loop to said transfer device for insertion or said end of the weft yarn into said picking device prior to release of said first loop of the weft yarn from said retaining means for picking with said picking device.

2. A picking arrangement as set forth in claim 1 wherein said first tensioning device includes a pair of yarn guides for guiding the weft yarn therebetween and a yarn tensioner having a bar disposed transversely of the weft yarn for reciprocating movement between said guides and between said initial position and a release position.

3. A picking arrangement as set forth in claim 2 wherein said second tensioning device includes at least one pair of yarn guides for guiding the weft yarn therebetween and a yarn tensioner for reciprocating between said yarn guides and between said initial position and said release position of said second tensioning device.

4. A picking arrangement as set forth in claim 3 wherein said yarn tensioner is a pivotally mounted lever.

5. A picking arrangement as set forth in claim 3 wherein said yarn tensioner of said second tensioning device includes at least two deflectors on one side of the weft yarn for movement relative to three of said yarn guides to define two loops of weft yarn.

6. A picking arrangement as set forth in claim 2 wherein said second tensioning device includes a tensioner connected to one of said yarn guides to move said one yarn guide between two positions corresponding to said initial position and said release position of said second tensioning device.

7. A picking arrangement as set forth in claim 6 wherein said one yarn guide is movable into a position corresponding to said release position of said tensioning device below said transfer device.

8. A picking arangement as set forth in claim 1 wherein said retaining means includes a pair of retaining elements for releasably holding the weft yarn therebetween between said initial position and a release position of said first tensioning device to permit release of said first loop.

9. A picking arrangement as set forth in claim 1 further comprising means for operating said second tensioning device and said first tensioning device in sequential synchronism.

10. A picking arrangement for two weft yarns as set forth in claim 1 which includes a pair of said first tensioning devices for respectively forming a first loop in each weft yarn and wherein said second tensioning device is common to said pair of tensioning devices to alternatively release a second loop from each weft yarn to a respective picking means.

11. A picking arrangement for at least one weft yarn in a weaving machine comprising a first tensioning device for forming a first loop in a weft yarn;

retaining means for releasably holding said first loop in an initial position of said first tensioning device;

a transfer device for retaining the weft yarn for insertion of an end of the weft yarn into a picking device;

a second tensioning device for forming a second loop in the weft yarn upstream of said transfer device for insertion of the weft yarn end into a picking device; and means for sequentially actuating said second tensioning device after said first tensioning device.

12. A picking arrangement as set forth in claim 11 wherein said transfer device is a pneumatic nozzle.

13. A picking arrangement for at least one weft yarn in a weaving machine comprising a first weft yarn tensioning device including a pair of yarn guides for guiding a weft yarn therebetween, a yarn tensioner having a bar disposed transversely of the weft yarn for reciprocating movement between said guides and between an initial position to form a loop of weft yarn and a release position, and retaining means for releasably holding weft yarn in said initial position;

a weft yarn transfer device for retaining the weft yarn;

a picking device for receiving an end of the weft yarn from said transfer device for picking; and a second weft yarn tensioning device upstream of said transfer device and movable between an initial position to hold at least a second loop of weft yarn thereat and a release position to release said second loop to said transfer device for insertion of said end of the weft yarn into said picking device, said second tensioning device including at least three yarn guides for guiding the weft yarn therebetween and a yarn tensioner for reciprocating between said yarn guides and between said initial position and said release position of said second tensioning device, said yarn tensioner including at least two deflectors on one side of the weft yarn for movement relative to three of said yarn guides to define two loops of weft yarn.

14. A picking arrangement for at least one weft yarn in a weaving machine comprising a first weft yarn tensioning device including a pair of yarn guides for guiding a weft yarn therebetween, a yarn tensioner having a bar disposed transversely of the weft yarn for reciprocating movement between said guides and between an initial position to form a first loop of weft yarn and a release position, and retaining means for releasably holding the weft yarn in said initial position;

a weft yarn transfer device for retaining the weft yarn;

a picking device for receiving an end of the weft yarn from said transfer device for picking; and a second weft yarn tensioning device upstream of said transfer device and movable between an initial position to hold at least a second loop of weft yarn thereat and a release position to release said second loop to said transfer device for insertion of said end of the weft yarn into said picking device, said second tensioning device includes a tensioner connected to one of said yarn guides to move said one yarn guide between two positions corresponding to said initial position and said release position of said second tensioning device.

15. A picking arrangement as set forth in claim 14 wherein said one yarn guide is movable into a position corresponding to said release position of said second tensioning device below said transfer device.

* * * * *

UNITED STATES PATENT AND TRADEMARK OFFICE

CERTIFICATE OF CORRECTION

PATENT NO. : 4,649,965

DATED : March 17, 1987

INVENTOR(S) : Ernst Wenig, et al

It is certified that error appears in the above-identified patent and that said Letters Patent are hereby corrected as shown below:

Column 5, line 33 "th deflectors" should be -the deflectors-

Column 6, line 10 "arangement" should be -arrangement-

Column 6, line 22 "beteen" should be - between-

Signed and Sealed this

Seventeenth Day of November, 1987

*Attest:*

DONALD J. QUIGG

*Attesting Officer*

*Commissioner of Patents and Trademarks*